US011168493B2

(12) United States Patent
Kellokoski

(10) Patent No.: US 11,168,493 B2
(45) Date of Patent: Nov. 9, 2021

(54) ELECTROMECHANICAL LOCK

(71) Applicant: ILOQ Oy, Oulu (FI)

(72) Inventor: Mika Kellokoski, Haukipudas (FI)

(73) Assignee: ILOQ OY, Oulu (FI)

( * ) Notice: Subject to any disclaimer, the term of this patent is extended or adjusted under 35 U.S.C. 154(b) by 331 days.

(21) Appl. No.: 16/485,895

(22) PCT Filed: Feb. 15, 2018

(86) PCT No.: PCT/EP2018/053785
§ 371 (c)(1),
(2) Date: Aug. 14, 2019

(87) PCT Pub. No.: WO2018/149919
PCT Pub. Date: Aug. 23, 2018

(65) Prior Publication Data

US 2020/0011089 A1 Jan. 9, 2020

(30) Foreign Application Priority Data

Feb. 16, 2017 (EP) ..... 17156443

(51) Int. Cl.
*E05B 47/00* (2006.01)

(52) U.S. Cl.
CPC .. *E05B 47/0001* (2013.01); *E05B 2047/0062* (2013.01); *E05B 2047/0088* (2013.01)

(58) Field of Classification Search
CPC ..... E05B 47/0001; E05B 2047/0062; E05B 2047/0088; E05B 47/02; E05B 47/00;
(Continued)

(56) References Cited

U.S. PATENT DOCUMENTS 4,912,460 A * 3/1990 Chu ..... G07C 9/00658 310/330
8,228,030 B2 * 7/2012 Pukari ..... G07C 9/00309 320/114

(Continued)

FOREIGN PATENT DOCUMENTS

CN 101315001 12/2008
CN 101397866 4/2009

(Continued)

OTHER PUBLICATIONS

International Search Report for PCT/EP2018/053785 dated May 14, 2018, 3 pages.

(Continued)

*Primary Examiner* — Lloyd A Gall
(74) *Attorney, Agent, or Firm* — Nixon & Vanderhye PC

(57) ABSTRACT

The lock includes an actuator (130), a generator (160), an engagement mechanism (114) to convey mechanical insertion power to the electric generator (160), and an electronic circuit (120), powered by the electric power (310), to read encrypted data (312) from a memory (102) embedded into the key (100), and, if the encrypted data (312) matches a predetermined criterion, to operate the actuator (130), with the electric power (310), to set (314) the actuator (130) to the unlocked position (300). The engagement mechanism (114) is also configured to engage with an extraction (400) of the key (100) and convey mechanical extraction power to the electric generator (160), and the electronic circuit, powered by the electric power (600), is also configured to operate the actuator (130), with the electric power (600), to reset (602) the actuator (130) to the locked position (140).

9 Claims, 3 Drawing Sheets

(58) Field of Classification Search
CPC ..... E05B 2047/002; E05B 2047/0021; E05B 81/34; E05B 81/36
USPC ... 70/277, 278.2, 278.3, 278.7, 279.1, 283.1
See application file for complete search history.

(56) References Cited

U.S. PATENT DOCUMENTS

| | | | | |
|---|---|---|---|---|
| 8,468,861 | B2 * | 6/2013 | Pukari | G07C 9/00309 70/278.7 |
| 8,653,939 | B2 * | 2/2014 | Johnson | G06K 13/0856 340/5.67 |
| 8,899,081 | B2 * | 12/2014 | Pukari | E05B 47/0012 70/277 |
| 8,981,899 | B2 * | 3/2015 | Pukari | E05B 47/063 340/5.73 |
| 9,574,376 | B2 * | 2/2017 | Kananen | E05B 15/04 |
| 2016/0160531 | A1 | 6/2016 | Piirainen et al. | |

FOREIGN PATENT DOCUMENTS

| | | |
|---|---|---|
| CN | 101755099 | 6/2010 |
| CN | 101755289 | 6/2010 |
| DE | 32 08 818 | 9/1983 |
| EP | 0 623 723 | 11/1994 |
| EP | 1 808 816 | 7/2007 |
| EP | 2 017 412 | 1/2009 |
| EP | 2 017 413 | 1/2009 |
| EP | 2 017 795 | 1/2009 |
| EP | 2 043 055 | 4/2009 |
| EP | 2 157 552 | 2/2010 |
| EP | 2 336 460 | 6/2011 |
| EP | 2 354 389 | 8/2011 |
| EP | 2 592 601 | 5/2013 |
| EP | 2 674 552 | 12/2013 |
| EP | 2 859 162 | 4/2015 |
| EP | 3 118 977 | 1/2017 |
| WO | 00/60197 | 10/2000 |
| WO | WO 2007/068794 | 6/2007 |
| WO | WO 2009/010635 | 1/2009 |
| WO | WO 2009/010638 | 1/2009 |
| WO | 2013/186198 | 12/2013 |
| WO | 2014/199012 | 12/2014 |

OTHER PUBLICATIONS

Written Opinion of the ISA for PCT/EP2018/053785, dated May 14, 2018, 6 pages.
Office Action issued in CN Appln. No. 201880007629.5 dated Jun. 2, 2020 (w/ partial translation).

* cited by examiner

ELECTROMECHANICAL LOCK

This application is the U.S. national phase of International Application No. PCT/EP2018/053785 filed 15 Feb. 2018, which designated the U.S. and claims priority to EP Patent Application No. 17156443.8 filed 16 Feb. 2017, the entire contents of each of which are hereby incorporated by reference.

FIELD

The invention relates to an electromechanical lock.

BACKGROUND

Electromechanical locks are replacing traditional mechanical locks. As this technology becomes more popular, further refinement is desirable, such as improving the mechanical structure.

DE 3208818 A1 discloses an electromechanical lock with an engagement mechanism.

BRIEF DESCRIPTION

The present invention seeks to provide an improved electromechanical lock.

According to an aspect of the present invention, there is provided an electromechanical lock.

The invention provides an improved mechanical structure as an electrically-operated actuator of the electromechanical lock is operated solely with electrical power both while setting the actuator in an unlocked position and while resetting the actuator in a locked position.

LIST OF DRAWINGS

Example embodiments of the present invention are described below, by way of example only, with reference to the accompanying drawings, in which FIGS. 1, 2, 3, 4, 5 and 6 illustrate example embodiments of the electromechanical lock;

FIG. 7 illustrates a side view of a part of a generator and an engagement mechanism; and FIG. 8 illustrates an enlarged and partial sectional view of FIG. 7 along line 8-8.

DESCRIPTION OF EMBODIMENTS

The following embodiments are only examples. Although the specification may refer to "an" embodiment in several locations, this does not necessarily mean that each such reference is to the same embodiment(s), or that the feature only applies to a single embodiment. Single features of different embodiments may also be combined to provide other embodiments. Furthermore, words "comprising" and "including" should be understood as not limiting the described embodiments to consist of only those features that have been mentioned and such embodiments may contain also features/structures that have not been specifically mentioned.

The applicant has invented many improvements for electromechanical locks, such as those described in patents/applications, incorporated herein as references in all jurisdictions where applicable: EP 1808816, EP 2017412, EP 2017795, EP 07112673.4, EP 07117498.1, EP 2157552, EP 2336460, EP 2354389, EP 2592601, EP 2674552, EP 2859162, and EP 15176420.6. A discussion of those details is not presented here, but the reader is advised to consult those patents/applications if information is needed for any purpose.

Let us now turn to FIGS. 1, 2, 3, 4, 5 and 6, which illustrate example embodiments of an electromechanical lock, but with only such parts shown that are relevant to the present example embodiments.

Note that FIGS. 1, 2 and 3 illustrate an opening sequence of the electromechanical lock, wherein an insertion 150 of a key 100 powers the electromechanical lock, whereas FIGS. 4, 5 and 6 illustrate a closing sequence of the electromechanical lock, wherein an extraction 400 of the key 100 powers the electromechanical lock.

The electromechanical lock comprises an electrically-operated actuator 130 to move between a locked position 140 and an unlocked position 300.

In an example embodiment, the actuator 130 is a transducer that accepts electric energy and produces a kinetic energy of movement (=action between the locked position 140 and the unlocked position 300). In an example embodiment, the actuator 130 is implemented with an electric motor, which is an electrical machine that converts electrical energy into mechanical energy. In an example embodiment, the actuator 130 is implemented with a stepper motor, which may be capable of producing precise rotations. In an example embodiment, the actuator 130 is implemented with a solenoid, such as an electromechanical solenoid converting electrical energy into motion.

In an example embodiment, the electromechanical lock may be placed in a lock cylinder, and the actuator 130 may control a latch mechanism (or a lock bolt) moving in and out (of a door fitted with the lock, for example).

The electromechanical lock also comprises an electric generator 160 to produce electric power from mechanical power.

The electromechanical lock also comprises an engagement mechanism 114 mechanically coupled with the electric generator 160 to engage with the insertion 150 of the key 100 and convey mechanical insertion power to the electric generator 160.

The electromechanical lock also comprises an electronic circuit 120, powered by the electric power 310 produced from the mechanical insertion power, to read encrypted data 312 from a memory 102 embedded into the key 100, and, if the encrypted data 312 matches a predetermined criterion, to operate the actuator 130, with the electric power 310 produced from the mechanical insertion power, to set 314 the actuator 130 to the unlocked position 300.

The engagement mechanism 114 is also configured to engage with the extraction 400 of the key 100 and convey mechanical extraction power to the electric generator 160, and the electronic circuit, powered by the electric power 600 produced from the mechanical extraction power, is also configured to operate the actuator 130, with the electric power 600 produced from the mechanical extraction power, to reset 602 the actuator 130 to the locked position 140.

With this kind of operation, the setting 312 of the actuator 130 to the unlocked position 300, and resetting 602 of the actuator 130 to the locked position 140, are both made with electric power 310, 600 only. This simplifies the mechanical structure of the electromechanical lock as both the setting 312 and the resetting 602 of the actuator 120 do not need mechanical power.

In an example embodiment, the engagement mechanism 114 comprises a rotatable contact member, which comprises a first contact surface 116 to engage with the key 100 in the insertion 150, and a second contact surface 118 on the opposite side of the first contact surface 116 to engage with the key 100 in the extraction 400.

In an example embodiment, the rotatable contact member of the engagement mechanism 114 is configured to rotate in a first rotation direction 200 during the insertion 150 of the key 100, and rotate in a second rotation 500 direction opposite to the first rotation direction 200 during the extraction 400 of the key 100.

In an example embodiment, the first contact surface 116 is configured to engage with a first key surface 106 of the key 100 in the insertion 150, the second contact surface 118 is configured to engage with second key surface 104 of the key 100 opposite to the first key surface 106 in the extraction 400, and the rotatable contact member of the engagement mechanism 114 is configured, after the insertion 150 and before the extraction 400, to rotate in the second direction 320 to position the second contact surface 118 to face the second key surface 104.

In an example embodiment, the engagement mechanism 114 is configured to resist the insertion 150 of the key 100 until a first predetermined momentum is overcome and a sufficient amount of electric power 310 is produced from the mechanical insertion power to power the electronic circuit 120 and operate the actuator 130 to set the actuator 130 to the unlocked position 140, and the engagement mechanism 114 is further configured to resist the extraction 400 of the key 100 until a second predetermined momentum is overcome and a sufficient amount of electric power 600 is produced from the mechanical extraction power to power the electronic circuit 120 and operate the actuator 130 to reset the actuator 130 to the locked position 140.

Figure 1:
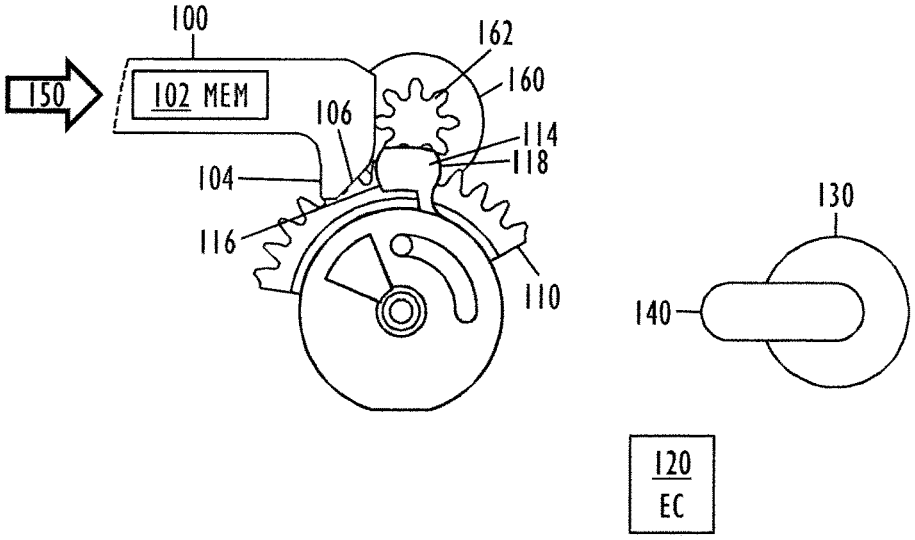
Figure 2:
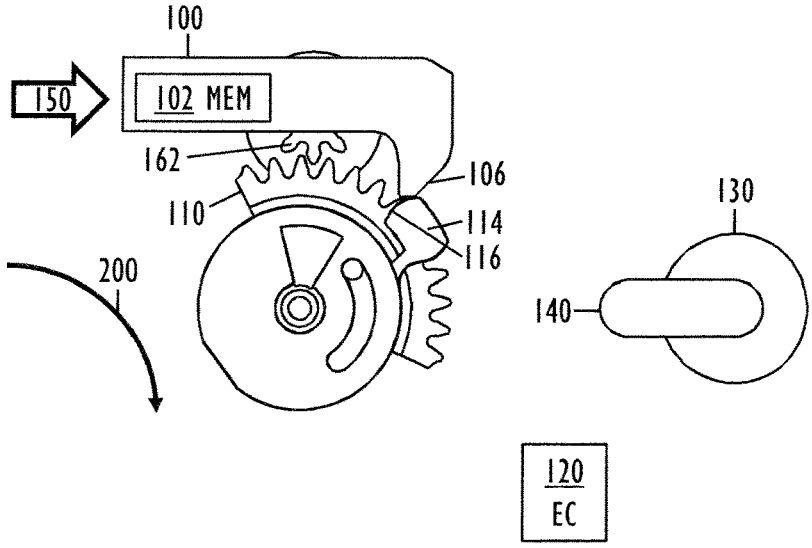
Figure 3:
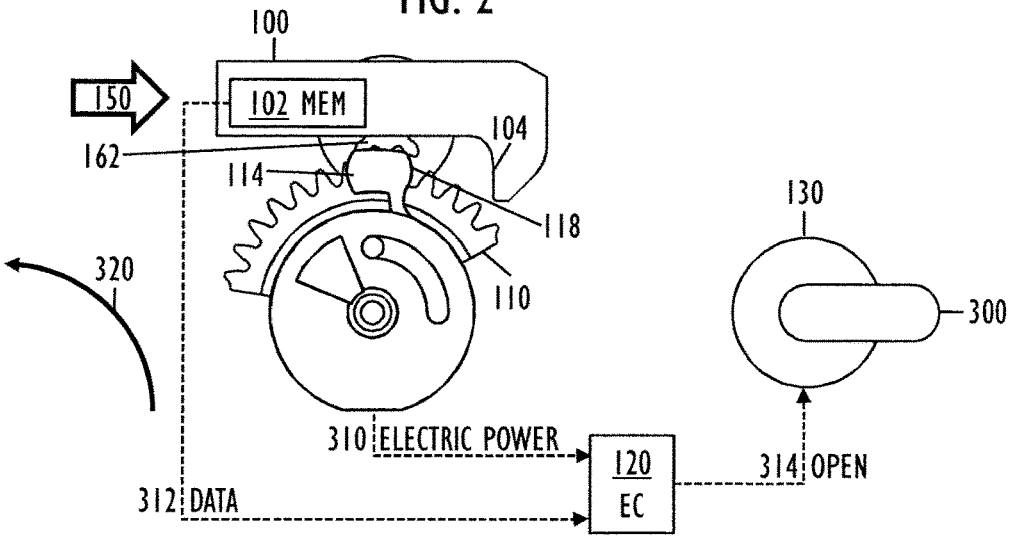
Figure 4:
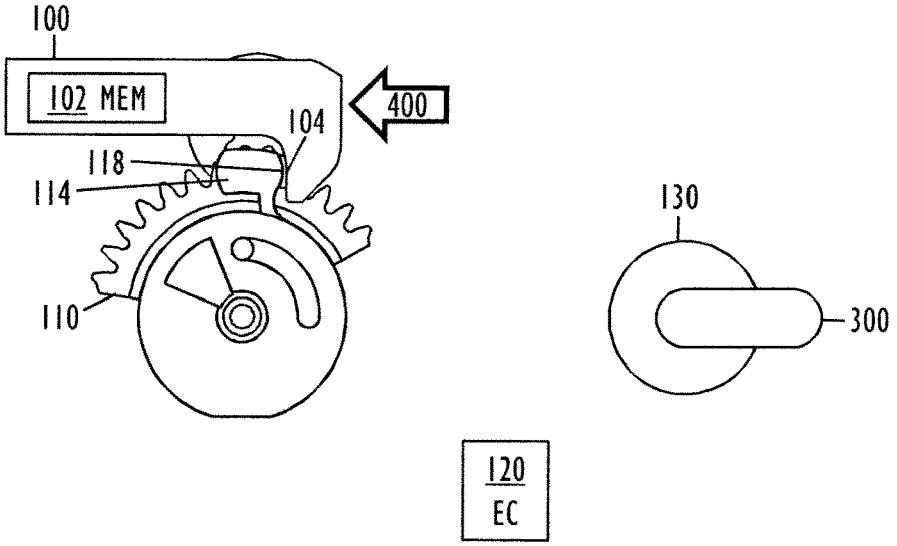
Figure 5:
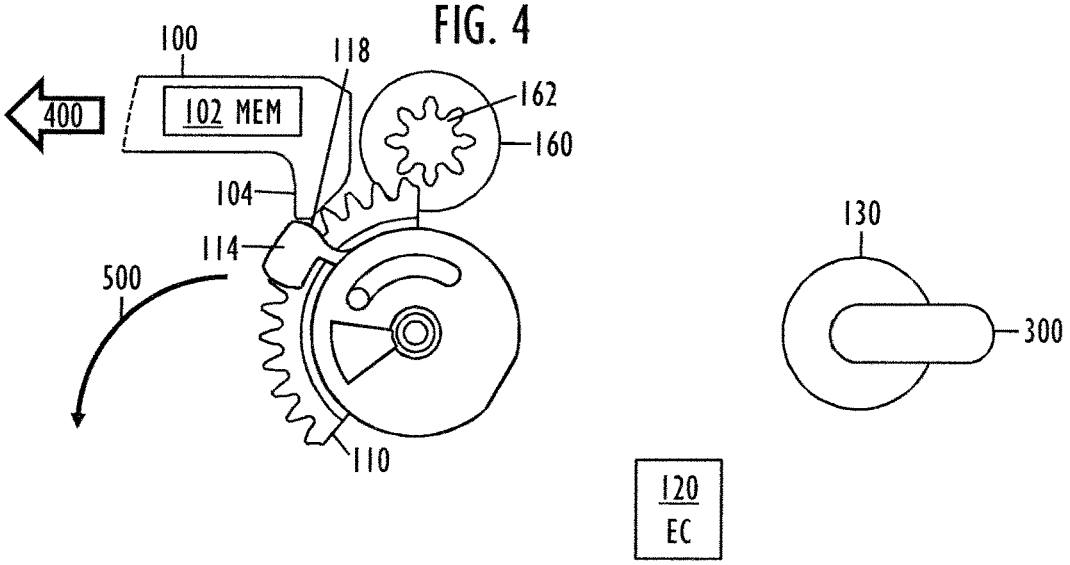
Figure 6:
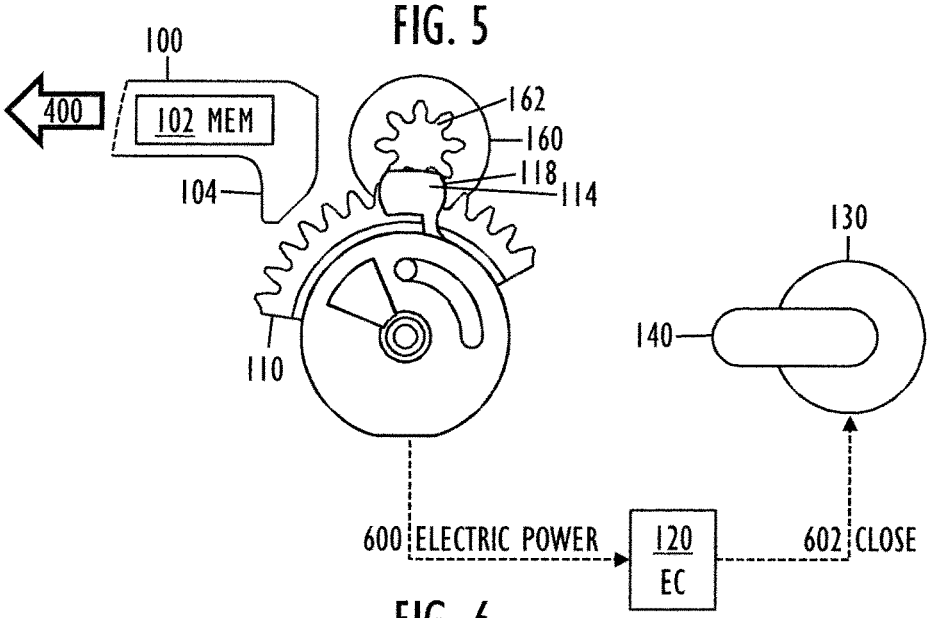
Figure 7:
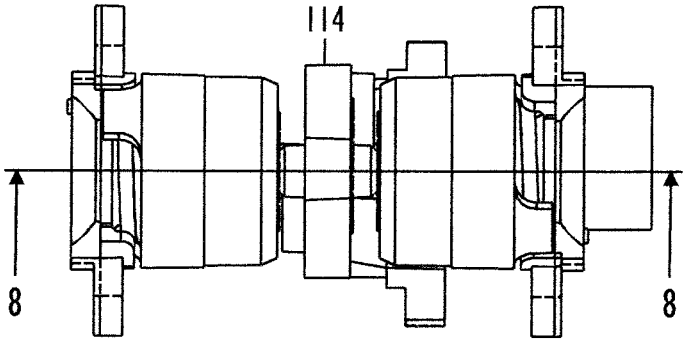
FIG. 7 illustrates a side view of the engagement mechanism 114.

In an example embodiment, the engagement mechanism 114 comprises a first spring 800 to resist with the first predetermined momentum, and a second spring 802 to resist with the second predetermined momentum.

In an example embodiment, the engagement mechanism 114 is configured to tense the first spring 800 during the insertion 150 of the key 100, and, after the first predetermined momentum is overcome, to rotate the generator 160 to produce the electric power 310 with a released force from the first spring 800, and the engagement mechanism 114 is configured to tense the second spring 802 during the extraction 400 of the key 100, and, after the second predetermined momentum is overcome, to rotate the generator 160 to produce the electric power 600 with a released force from the second spring 802.

In an example embodiment, the first spring 800 and the second spring 802 are coil springs.

Figure 8:
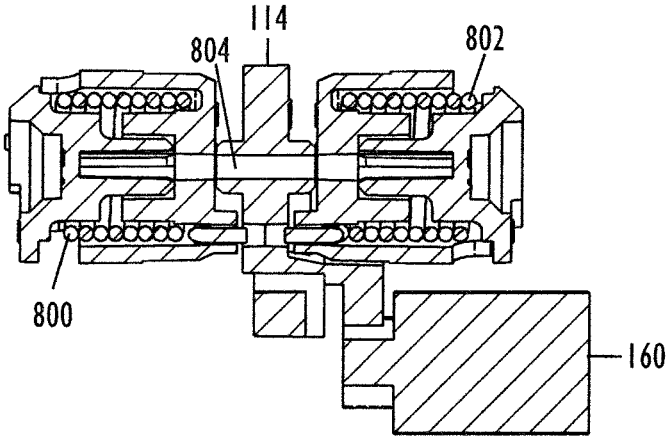
FIG. 8 illustrates an enlarged and partial sectional view of FIG. 7 along line 8-8.

In an example embodiment, illustrated in FIGS. 1 and 8, the engagement mechanism 114 comprises a (partial) gearwheel 110, which, during the insertion 150 and during the extraction 400, rotates around an axle 804 in order to tense the springs 800, 802. As the spring tension is released, the gearwheel 110 rotates a gearwheel 162 coupled with an axle of the generator 160 to produce the electric power from the mechanical power (stored in first spring 800 during the insertion 150 and in the second spring 802 during the extraction 400).

It will be obvious to a person skilled in the art that, as technology advances, the inventive concept can be implemented in various ways. The invention and its embodiments are not limited to the example embodiments described above but may vary within the scope of the claims.

The invention claimed is:

1. An electromechanical lock comprising:

an electrically-operated actuator to move between a locked position and an unlocked position;

an electric generator to produce electric power from mechanical power;

an engagement mechanism mechanically coupled with the electric generator to engage with an insertion of a key and convey mechanical insertion power to the electric generator; and an electronic circuit, powered by the electric power produced from the mechanical insertion power, to read encrypted data from a memory embedded into the key, and, if the encrypted data matches a predetermined criterion, to operate the actuator, with the electric power produced from the mechanical insertion power, to set the actuator to the unlocked position;

wherein the engagement mechanism is also configured to engage with an extraction of the key and convey mechanical extraction power to the electric generator and the electronic circuit, powered by the electric power produced from the mechanical extraction power, is also configured to operate the actuator, with the electric power produced from the mechanical extraction power, to reset the actuator to the locked position; and wherein the engagement mechanism is configured to resist the insertion of the key until a first predetermined momentum is overcome and a sufficient amount of electric power is produced from the mechanical insertion power to power the electronic circuit and operate the actuator to set the actuator to the unlocked position, and the engagement mechanism is further configured to resist the extraction of the key until a second predetermined momentum is overcome and a sufficient amount of electric power is produced from the mechanical extraction power to power the electronic circuit and operate the actuator to reset the actuator to the locked position;

wherein the engagement mechanism comprises a first spring to resist with the first predetermined momentum, and a second spring to resist with the second predetermined momentum.

2. The electromechanical lock of claim 1, wherein the engagement mechanism comprises a rotatable contact member, which comprises a first contact surface to engage with the key in the insertion, and a second contact surface on the opposite side of the first contact surface to engage with the key in the extraction.

3. The electromechanical lock of claim 2, wherein the rotatable contact member of the engagement mechanism is configured to rotate in a first rotation direction during the insertion of the key, and rotate in a second rotation direction opposite to the first rotation direction during the extraction of the key.

4. The electromechanical lock of claim 3, wherein the first contact surface is configured to engage with a first key surface of the key in the insertion, the second contact surface is configured to engage with a second key surface of the key opposite to the first key surface in the extraction, and the rotatable contact member of the engagement mechanism is configured, after the insertion and before the extraction, to rotate in the second direction to position the second contact surface to face the second key surface.

5. The electromechanical lock of claim 1, wherein the engagement mechanism is configured to tense the first spring during the insertion of the key, and, after the first predetermined momentum is overcome, to rotate the generator to produce the electric power with a released force from the first spring, and the engagement mechanism is configured to tense the second spring during the extraction of the key, and, after the second predetermined momentum is overcome, to rotate the generator to produce the electric power with a released force from the second spring.

6. The electromechanical lock of claim 5, wherein the engagement mechanism comprises a gearwheel, which, during the insertion and during the extraction, rotates around an axle in order to tense the springs, and, as the spring tension is released, the gearwheel rotates a gearwheel coupled with an axle of the generator to produce the electric power from the mechanical power.

7. The electromechanical lock of claim 2, wherein the engagement mechanism is configured to tense the first spring during the insertion of the key, and, after the first predetermined momentum is overcome, to rotate the generator to produce the electric power with a released force from the first spring, and the engagement mechanism is configured to tense the second spring during the extraction of the key, and, after the second predetermined momentum is overcome, to rotate the generator to produce the electric power with a released force from the second spring.

8. The electromechanical lock of claim 3, wherein the engagement mechanism is configured to tense the first spring during the insertion of the key, and, after the first predetermined momentum is overcome, to rotate the generator to produce the electric power with a released force from the first spring, and the engagement mechanism is configured to tense the second spring during the extraction of the key, and, after the second predetermined momentum is overcome, to rotate the generator to produce the electric power with a released force from the second spring.

9. The electromechanical lock of claim 4, wherein the engagement mechanism is configured to tense the first spring during the insertion of the key, and, after the first predetermined momentum is overcome, to rotate the generator to produce the electric power with a released force from the first spring, and the engagement mechanism is configured to tense the second spring during the extraction of the key, and, after the second predetermined momentum is overcome, to rotate the generator to produce the electric power with a released force from the second spring.

* * * * *